US008113170B2

(12) United States Patent
Jacobsen et al.

(10) Patent No.: US 8,113,170 B2
(45) Date of Patent: Feb. 14, 2012

(54) METHOD FOR IDLE SPEED CONTROL

(75) Inventors: Brent Jacobsen, Ann Arbor, MI (US); Mike Ryan Scannell, New Boston, MI (US); Ron Reichenbach, Troy, MI (US); Hugh Hamilton, Troy, MI (US); Marian Sue Chupa, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/170,046

(22) Filed: Jun. 27, 2011

(65) Prior Publication Data

US 2011/0257866 A1 Oct. 20, 2011

Related U.S. Application Data

(62) Division of application No. 12/365,502, filed on Feb. 4, 2009, now Pat. No. 8,001,950.

(51) Int. Cl.
*F02D 1/00* (2006.01)

(52) U.S. Cl. ..... 123/339.1; 123/339.16; 123/179.3

(58) Field of Classification Search ..... 123/339.1, 123/339.11, 339.16, 339.23, 179.3, 406.23
See application file for complete search history.

(56) References Cited

U.S. PATENT DOCUMENTS

| | | | | |
|---|---|---|---|---|
| 4,645,025 | A * | 2/1987 | Ohe et al. | 180/412 |
| 5,947,084 | A | 9/1999 | Russell et al. | |
| 6,675,758 | B2 | 1/2004 | Nagata et al. | |
| 6,779,624 | B2 * | 8/2004 | Goto et al. | 180/403 |

* cited by examiner

*Primary Examiner* — John Kwon
(74) *Attorney, Agent, or Firm* — Julia Voutyras; Alleman Hall McCoy Russell & Tuttle LLP

(57) ABSTRACT

A method is disclosed for controlling engine output in a vehicle having a hydraulic power steering system. The method may include, during an idle condition where an engine speed is set to an idle speed, adjusting engine output based on a learned absolute steering wheel angle to compensate for changes in engine load caused by operation of the hydraulic power steering system. The learned absolute steering wheel angle may be based on a steering wheel angle relative to a steering wheel position at vehicle startup and operating conditions from previous vehicle operation before the vehicle startup.

10 Claims, 5 Drawing Sheets

METHOD FOR IDLE SPEED CONTROL

CROSS REFERENCE TO RELATED APPLICATIONS

The present application is a divisional of U.S. patent application Ser. No. 12/365,502 filed Feb. 4, 2009, the entire contents of which are incorporated herein by reference.

BACKGROUND AND SUMMARY

Vehicle operating efficiency may be greatly affected by fuel economy performance. One contributor to reduced fuel economy is a high minimum engine idle speed, because all fuel that is consumed at idle does not contribute to vehicle movement and thus lowers the vehicle operating efficiency. The biggest restriction to reducing engine idle speeds and consequently reducing this wasted fuel usage is the need to power engine accessories and quickly compensate for changes in these accessory loads. One such load is the power steering system.

Most automobiles are equipped with a hydraulic power steering system. This system mounts a hydraulic pump on the engine accessory drive. As the steering wheel is moved, the steering gear uses hydraulic pressure from the pump to assist with turning the vehicle wheels. Suspension design and power steering gear design can result in very high and difficult to predict hydraulic loads which cascade as engine loads. This happens frequently at idle, and can result in large fluctuations in engine speed. One approach to compensate for fluctuations in engine load includes setting the engine idle speed higher than might otherwise be necessary in order to mitigate the fluctuations. In another approach, a power steering torque requirement used to control engine idle speed is estimated based on a steering wheel angle sensor signal. An example of this approach is disclosed in U.S. Pat. No. 5,947,084.

However, the inventors herein have recognized various issues with the above approach. For example, estimating power steering torque load based directly on a signal from the steering wheel angle sensor may result in inaccuracies in torque estimation. In particular, a steering wheel sensor may only generate a signal that indicates an angle of the steering wheel that is relative to a steering wheel position at vehicle startup. The steering wheel angle sensor signal is not relative to a center or end-of-travel position of the steering wheel. Thus, the power steering load estimation of the above described approach may not identify particular absolute steering wheel angular positions that cause increases in engine load. Such estimations may result in less accurate engine idle speed control that utilizes a higher minimum idle speed that leads to increased fuel consumption.

The above issues may be addressed by a method for controlling engine output of an internal combustion engine of a vehicle having a hydraulic power steering system during an idle condition to compensate for variations in engine load due to operation of the power steering system. One embodiment of the method may include, during an idle condition where an engine speed is set to an idle speed, adjusting engine output based on a learned absolute steering wheel angle to vary the engine speed from the idle speed to compensate for changes in engine load caused by operation of the hydraulic power steering system. The learned absolute steering wheel angle may be based on a steering wheel angle relative to a steering wheel position at vehicle startup and operating conditions from previous vehicle operation before the vehicle startup.

By learning an absolute steering wheel angle that is defined relative to a center position of the steering wheel, regions of steering wheel angle defined relative to the center position where power steering operations contribute to increases in engine load may be accurately identified. The accurate identification of such regions may allow for more accurate adjustment of engine operation to compensate for the variations in engine load. Accordingly, the minimum engine idle speed may be reduced. In this way, fuel economy may be improved.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
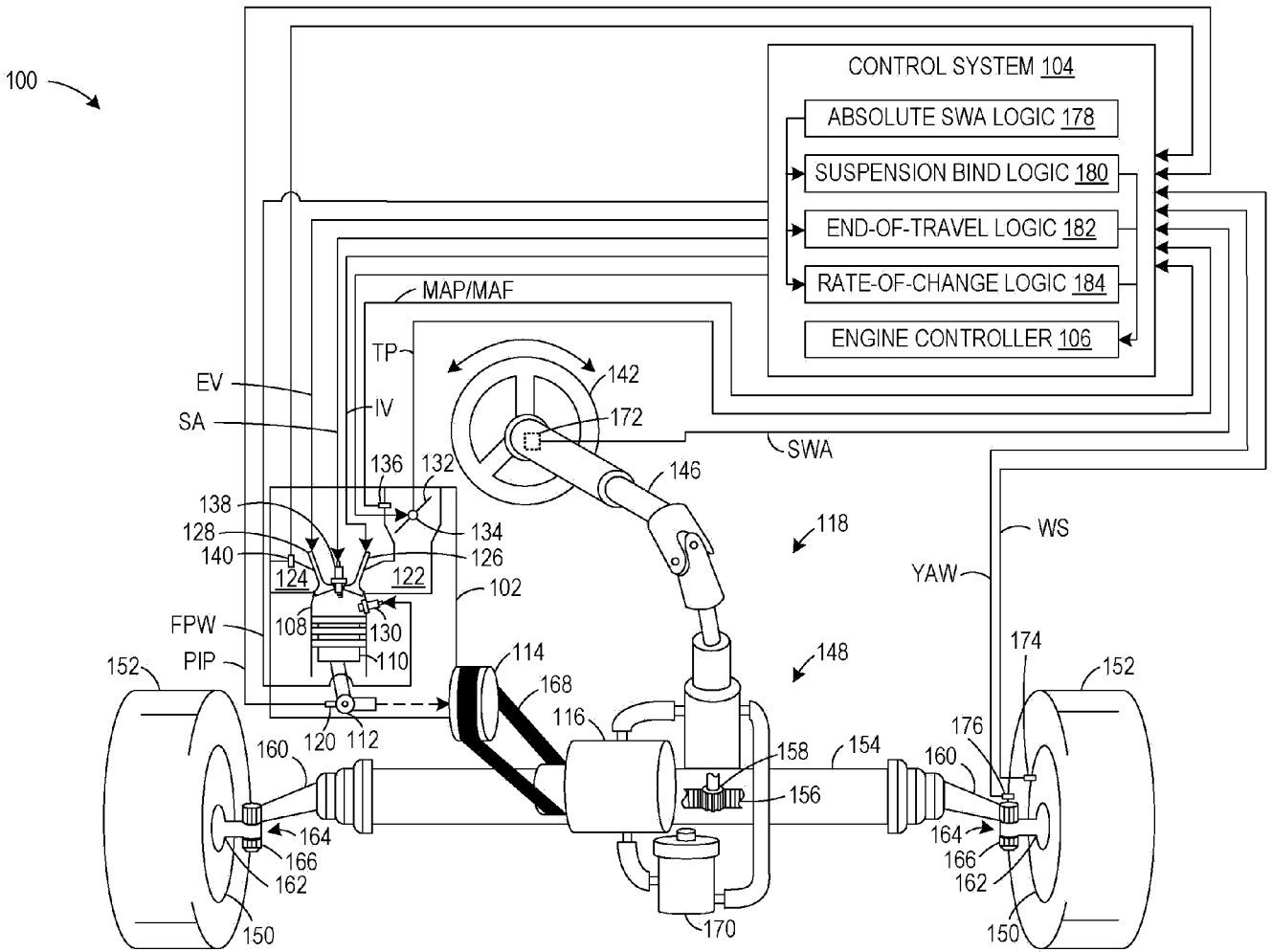
FIG. 1 is a schematic illustration of an example engine and power steering layout within a vehicle system.

The following description relates to a system for adjusting engine output to compensate for variations in engine load at idle due to power steering system operation. In one example, engine idle speed control is adjusted responsive to steering angle, where the adjustment of engine output (e.g., airflow, spark, etc.) is adjusted responsive to a desired engine idle speed and feedback of the actual engine speed, in combination with adjustment of the engine output based on steering adjustments in coordination with the engine speed feedback to control the actual engine speed to the desired idle speed. FIG. 1 is a schematic diagram showing a vehicle 100. Vehicle 100 includes a multi-cylinder engine 102 of which one cylinder is shown. Engine 102 may be controlled at least partially by a control system 104 including engine controller 106 and by input from a vehicle operator via various input devices. In one example, an input device includes an accelerator pedal and a pedal position sensor for generating a proportional pedal position signal that is used by engine controller 106 to determine engine load and adjust engine output. Combustion chamber (i.e. cylinder) 108 of engine 102 may include piston 110 positioned therein. Piston 110 may be coupled to crankshaft 112 so that reciprocating motion of the piston is translated into rotational motion of the crankshaft. Crankshaft 112 may be coupled to at least one drive wheel of a vehicle via an intermediate transmission system. Further, rotation of crankshaft 112 may be applied to output shaft 114 to operate hydraulic pump 116 to create pressure in power steering system 118. A Hall effect sensor 120 (or other type) may be coupled to crankshaft 112 to provide profile ignition pickup signal PIP to control system 104.

Combustion chamber 108 may receive intake air from intake manifold 122 and may exhaust combustion gases via exhaust passage 124. Intake manifold 122 and exhaust passage 124 can selectively communicate with combustion chamber 108 via respective intake valve 126 and exhaust valve 128. In some embodiments, combustion chamber 108 may include two or more intake valves and/or two or more exhaust valves.

Intake valve 126 may be controlled by control system 104 via electric valve actuation (EVA) according to intake valve control signal IV. Likewise exhaust valve 128 may be controlled by control system 104 via EVA according to exhaust valve control signal EV. During some conditions, engine controller 106 may vary the signals provided to controllers of intake valve 126 and/or exhaust valve 128 to control the opening and closing of the respective intake and exhaust valves. In alternative embodiments, one or more of the intake and exhaust valves may be actuated by one or more cams, and may utilize one or more of cam profile switching (CPS), variable cam timing (VCT), variable valve timing (VVT) and/or variable valve lift (VVL) systems to vary valve operation. For example, combustion chamber 108 may alternatively include an intake valve controlled via electric valve actuation and an exhaust valve controlled via cam actuation including CPS and/or VCT.

Fuel injector 130 is shown coupled directly to combustion chamber 108 for injecting fuel directly therein in proportion to the pulse width of signal FPW received from control system 104. In this manner, fuel injector 130 provides what is known as direct injection of fuel into combustion chamber 108. The fuel injector may be mounted in the side of the combustion chamber or in the top of the combustion chamber, for example. Fuel may be delivered to fuel injector 130 by a fuel system (not shown) including a fuel tank, a fuel pump, and a fuel rail. In some embodiments, combustion chamber 108 may alternatively or additionally include a fuel injector arranged in the intake passage in a configuration that provides what is known as port injection of fuel into the intake port upstream of combustion chamber 108.

Intake manifold 122 may include a throttle 132 having a throttle plate. A throttle position sensor 134 may provide a throttle position signal TP to control system 104. Further, control system 104 may send a throttle position control signal to an electric motor or actuator included with throttle 132 to vary a position of the throttle plate, in what is commonly referred to as electronic throttle control (ETC). In this manner, throttle 132 may be operated to vary the intake air provided to combustion chamber 108 among other engine cylinders. Intake manifold may include a mass air flow and/or a manifold pressure sensor 136 for providing respective signals MAF/MAP to control system 104.

Spark plug 138 may provide spark for combustion in combustion chamber 108 via spark advance signal SA from control system 104, under select operating modes. Though spark ignition components are shown, in some embodiments, combustion chamber 108 or one or more other combustion chambers of engine 102 may be operated in a compression ignition mode, with or without an ignition spark.

Exhaust gas sensor 140 is shown coupled to exhaust passage 124. Sensor 140 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Exhaust gas sensor 140 may provide a signal EG indicative of exhaust gas characteristics to control system 104.

As described above, FIG. 1 shows only one cylinder of a multi-cylinder engine, and that each cylinder may similarly include its own set of intake/exhaust valves, fuel injector, spark plug, etc.

Continuing with FIG. 1, vehicle 100 may be controlled by various vehicle operator input devices, including steering wheel 142. The steering wheel 142 and attached steering shaft 146, located in the steering column, transmit a vehicle operator's movement of the steering wheel to steering gear 148. The steering gear 148 changes the rotary motion of steering wheel 142 to linear motion that is applied to turn wheels 150 including tires 152. In the illustrated example, the steering gear is a rack-and-pinion configuration that includes a tubular housing 154 containing toothed rack 156 and pinion gear 158. The tubular housing 154 is mounted rigidly to the vehicle body or frame to take the reaction to the steering effort. The pinion gear 158 is attached to the lower end of steering shaft 146 which translates motion of steering wheel 142, and meshes with teeth of rack 156. Tie rods 160 connect the ends of rack 156 to steering-knuckle arms 162 via ball joints 164 that include bushings 166. Further, steering-knuckle arms 162 couple to wheels 150. Accordingly, as steering wheel 142 rotates, pinion gear 158 moves rack 156 right or left which causes tie rods 160 and steering-knuckle arms 162 to turn wheels 150 and tires 152 in or out for steering. Alternatively, in some embodiments, a recirculating-ball steering configuration may be employed.

Power steering system 118 is provided to assist in turning wheels 150 and tires 152 based on rotation of steering wheel 142 by the vehicle operator. Power steering system 118 includes hydraulic pump 116 mounted to output shaft 114 of engine 102 via belt 168. The output shaft 114 may be an accessory drive of engine 102. Operation of hydraulic pump 116 causes power steering fluid to flow at high pressure into tubular housing 154. Rotation of steering wheel 142 causes the pressurized fluid to be directed one way or the other to assist in moving rack 156. Hydraulic fluid flows out of tubular housing 154 into reservoir 170. Further, reservoir 170 couples to hydraulic pump 116 to form a closed system. In some embodiments, the hydraulic pump may be driven by an electric motor instead of the engine output shaft. In some embodiments, an electric power steering system may be employed without a hydraulic system. In particular, sensors may detect the motion and torque of the steering column, and a computer module may apply assistive power via an electric motor coupled directly to either the steering gear or steering column.

A steering wheel angle (SWA) sensor 172 may be coupled to steering wheel 142 to provide a relative SWA signal to control system 104. That is, the relative SWA signal provides an indication of an angle of steering wheel 142 relative to an angle of the steering wheel detected at vehicle startup. The wheel speed sensor 174 may be located in a suitable position to sense the speed or rotational position of wheels 150 and may send a wheel speed signal to control system 104. A wheel position sensor 176 may be located in a suitable position to sense the yaw position or rotation of wheels 150 and may send a yaw position signal YAW to control system 104. In one example, wheel position sensor 176 is located proximate to ball joints 164 to detect rotation of steering-knuckle arms 162. In some embodiments, the wheel speed sensor and the wheel position sensor may be integrated in a brake control module (not shown). The relative steering wheel angle, wheel speed, and/or YAW signals may be utilized by computing system 104 for electronic stability control (ESC), brake control, or the like. Moreover, the signals may be utilized by control system 104 to adjust engine output to compensate for variations in engine load at idle as will be discussed in further detail below with reference to FIGS. 2-5.

Control system 104 may include engine controller 106 to control operation of engine 102. In one example, the engine controller is a microcomputer including microprocessor unit, input/output ports, an electronic storage medium for executable programs and calibration values, such as a read only memory chip in this particular example, random access memory, keep alive memory, and a data bus. Engine controller 106 may receive various signals from sensors coupled to engine 102, in addition to those signals previously discussed, including measurement of inducted mass air flow (MAF)/absolute manifold pressure (MAP) from sensor 136; a profile ignition pickup signal (PIP) from Hall effect sensor 120 (or other type) coupled to crankshaft 112; throttle position (TP) from a throttle position sensor 134. Engine speed signal, RPM, may be generated by engine controller 106 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder.

Furthermore, as discussed above, vehicle steering operations may generate variations in engine load at idle. The geometry of the vehicle's suspension creates several conditions that ultimately result in dragging of one or more tire across a road surface when the steering wheel is turned and the vehicle is stopped. In particular, a line drawn through one of ball-joints 164 on the front suspension intersects the road surface at a first point. The center of the contact patch of tires 152 occurs at a second point. For reasons of stability and steering returnability, these two points are not coincident. The distance between these points is called the "scrub radius". When a vehicle is stationary and the driver turns the wheel, two distinct conditions occur relative to this scrub radius.

In a first condition referred to as "suspension bind", which occurs upon turning of the steering wheel and prior to movement of the tires, the suspension of the vehicle absorbs the slack in the bushings of the ball-joint resulting in the bushings becoming loaded and the sidewalls of the tires becoming deformed. During this condition, torque and corresponding engine load increase very quickly. If the steering wheel is released during the suspension-bind condition, the steering wheel, the suspension, tires, etc. return to the pre-suspension-bind position resulting in a relief of torque and corresponding engine load.

In a second related condition referred to as "scuff" that occurs following suspension-bind, the tire is actually scuffed across the road surface in an arc around the ball-joint line intersection point. Torque and corresponding engine load is relatively stable but high during scuff, sitting at the high-end or maximum value of bind torque/engine load. Again, if the steering wheel is released during the scuff condition, the steering wheel, the suspension, tires, etc. return to the pre-suspension-bind position resulting in a relief of torque and corresponding engine load.

Another condition referred to as "end-of-travel" is related to the design of the steering gear which results in dead-heading of the hydraulic pressure at the end of steering wheel travel. This results in a large spike in hydraulic pressure and consequently engine load. Yet another condition referred to as "rate-of-change" is related to engine load variations based on the above described conditions. In particular, delays in filling of the intake manifold of the engine may occur at idle due to variations in engine load that occur during the above described conditions. These filing delays result in intake air requests being delayed (e.g., by approximately ½ second). The intake air request delays result in reactive air compensation being delivered too late to correct idle speed fluctuations.

In order to compensate for engine load variations based at least in part on the above described conditions, control system 104 includes software logic that determines changes in engine load based on the above conditions among other factors of steering operation. In particular, control system 104 includes suspension bind logic 180 that determines an engine load term due to the suspension-bind condition and scuff conditions, end-of-travel logic 182 that determines an engine load term due to the end-of-travel condition, and rate-of change logic 184 that determines an engine load term due to the rate-of-change condition.

Furthermore, each of the above described conditions directly relates to steering wheel position/movement relative to center and/or end-of-travel positions of the steering wheel. However, SWA sensor 172 only provides an indication of steering wheel position relative to a steering wheel position at vehicle startup. In order to accurately determine engine load variations due suspension-bind, scuff, and end-of-travel compensation, absolute SWA is used.

Accordingly, control system 104 includes absolute SWA logic 178 that provides an indication of continuous absolute steering wheel angle to the other logic modules (i.e., suspension-bind logic 180, end-of-travel logic 182, rate-of-change logic 184). All of the engine load terms calculated using absolute steering wheel angle (the bind term, the end-of-travel term, and the rate-of-change term) are summed and used to calculate the torque output required to overcome the engine load of the power steering system that may be utilized by engine controller 106 to adjust engine operation. By compensating for engine load variations due to power steering operation utilizing absolute steering wheel angle derived from an SWA sensor signal, engine load compensation based on hydraulic pressure need not be employed. This may allow for elimination of expensive and leaky hydraulic pressure sensors. In this way, vehicle manufacturing and maintenance costs may be reduced and vehicle reliability may be improved.

The above described logic modules may be embodied as software applications, hardware circuits, or firmware, such as storage medium read-only memory of control system 104 programmed with computer readable data representing instructions executable by a processor. Further, instructions or operations performed by the above described logic modules may be carried out by performing methods described below with reference to FIGS. 2-5 as well as other variants that are anticipated but not specifically listed.

Figure 2:
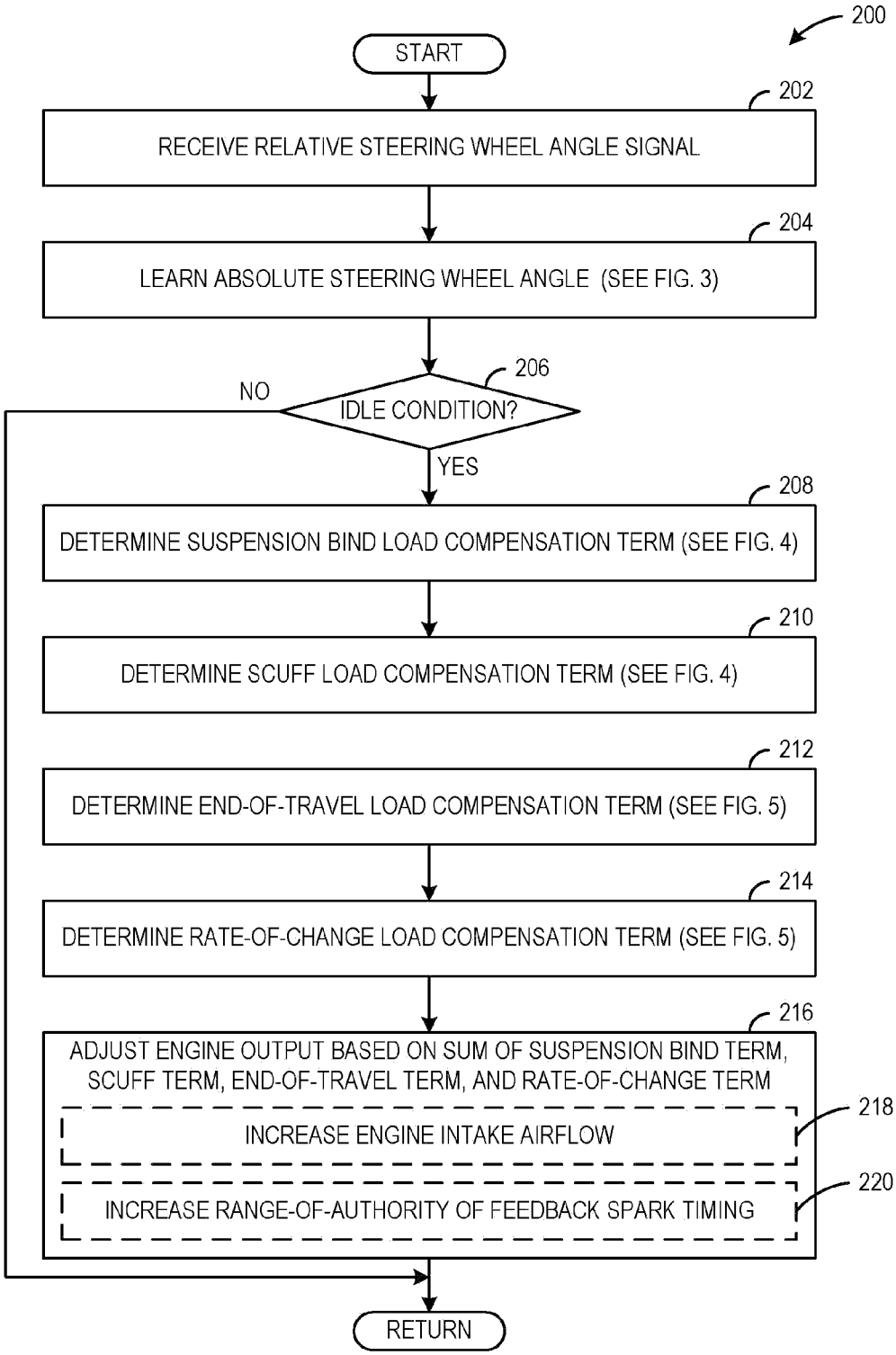
FIG. 2 is a flow diagram of an example method for adjusting engine output at idle to compensate for variations in engine load associated with power steering operation.

FIG. 2 is a flow diagram of an example high-level method 200 for controlling engine idle speed to compensate for variations in engine load due to power steering operation. The method may permit the engine idle speed to be set at a lower idle speed than would be feasible otherwise because the method may take into consideration increases in engine load due to power steering operation. Method 200 begins at 202 where the method may include receiving a relative SWA from a SWA sensor, such as SWA sensor 172 of FIG. 1. As discussed above, the relative SWA received from the SWA sensor may be a steering wheel position that is sensed relative to a starting steering wheel position, that is, a steering wheel positioned sensed at vehicle startup. At 204, the method may include learning an absolute SWA that may be used to determine variations in engine load due to power steering operation. The absolute SWA may be an angle measurement relative to a center position or end of travel position of the steering wheel. The absolute SWA may be used to determine each of the engine load compensation terms described below. An example method 300 for learning an absolute SWA will be discussed in further detail below with reference to FIG. 3.

At 206, the method may include determining if the vehicle is in an idle condition. In one example, an idle condition may be determined based on engine speed and vehicle speed. For example, an idle condition may exist when the vehicle speed is below a predetermined speed. If it is determined that the vehicle is in an idle condition the method moves to 208. Otherwise, the vehicle is not in an idle condition and the method returns to other operations.

At 208, the method may include determining engine load variation resulting from suspension bind produced during power steering operation. The determination may produce a suspension bind term that may be used to adjust engine idle speed to compensate for the variation in engine load. An example method 400 for determining the suspension bind load compensation term will be discussed in further detail below with reference to FIG. 4.

At 210, the method may include determining engine load variation resulting from scuff produced during power steering operation. An example method 400 for determining the scuff load compensation term will be discussed in further detail below with reference to FIG. 4.

At 212, the method may include determining engine load variation resulting from end-of-travel of the steering wheel. The determination may produce an end-of-travel term that may be used to adjust engine idle speed to compensate for the variation in engine load. At 214, the method may include determining engine load variation resulting from rate-of-change of the steering wheel. The determination may produce a rate-of-change term that may be used to adjust engine idle speed to compensation for the variation in engine load. An example method 500 for determining the end-of-travel load compensation term and the rate-of-change load compensation term will be discussed in further detail below with reference to FIG. 5.

At 216, the method may include adjusting engine idle speed to compensate for variances in engine load due to power steering operation. In particular, engine idle speed may be adjusted based on the sum of the suspension bind load compensation term, the scuff load compensation term, the end-of-travel load compensation term, and the rate-of-change load compensation term. In some embodiments, engine idle speed may be adjusted by increasing engine intake airflow at 218. In some embodiments, idle engine speed may be adjusted by increasing the range of authority of the spark feedback timing at 220. The adjustments to engine airflow and spark feedback authority will be discussed in further detail below with reference to FIG. 5.

By determining variations in engine load for each of the above compensation terms utilizing absolute SWA, expensive and leaky hydraulic pressure sensors may be eliminated. Moreover, the total reduction in engine speed fluctuations made possible by the enhancements of this method provide for elimination of power steering speed adders in the idle speed control strategy. Further, still by considering each of the above described conditions engine load compensation may be made more accurate and timely relative to previous approaches. As such, engine idle speed may be reduced for improved fuel economy performance.

Figure 3:
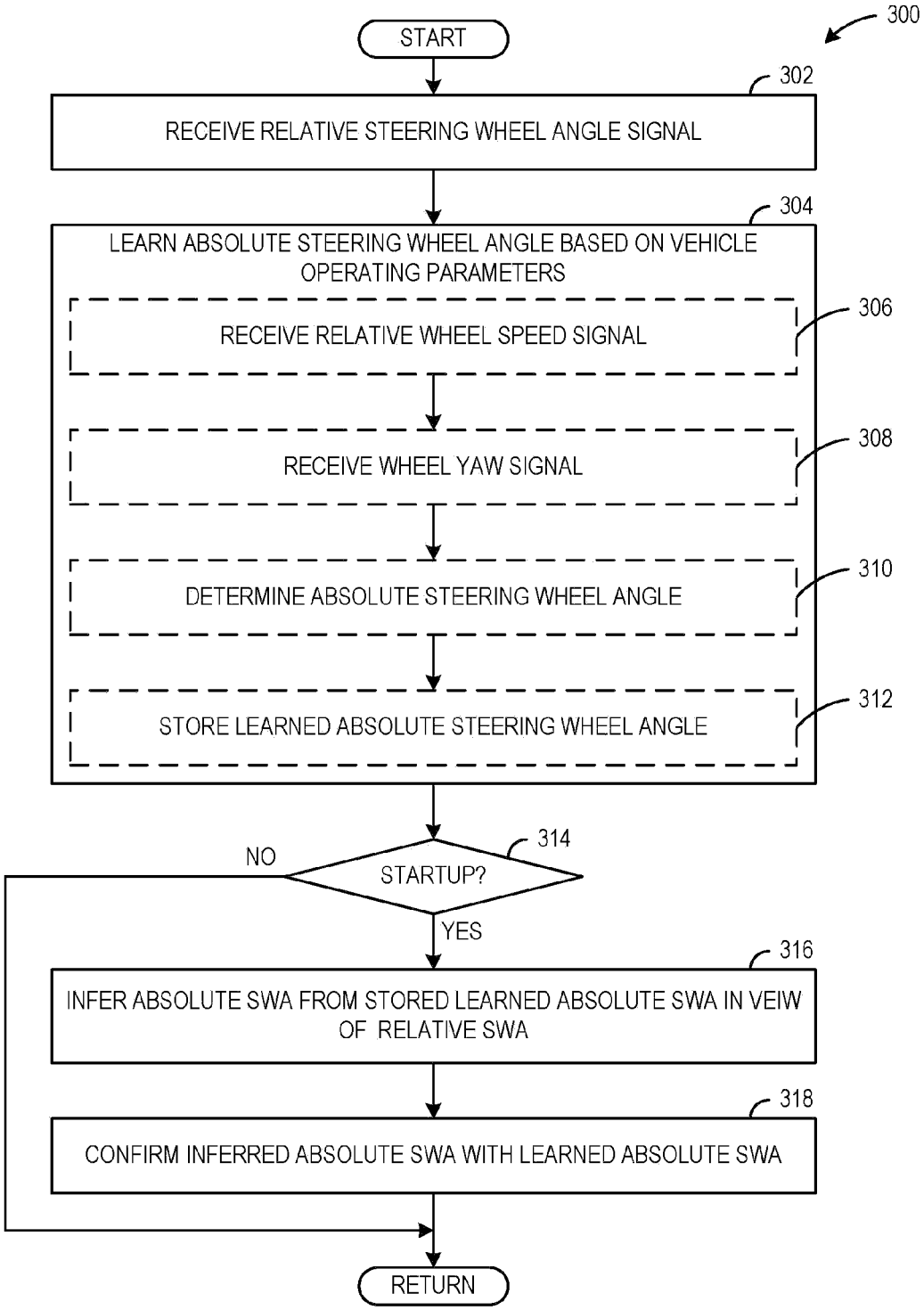
FIG. 3 is a flow diagram of an example method for determining absolute steering wheel angle used to determine variation in engine load due to power steering operation.

FIG. 3 is a flow diagram of an example method 300 for learning a continuous absolute SWA from the sensed relative SWA. The SWA sensor 172 in FIG. 1 senses relative SWA (i.e., it is not relative to center or end of travel, only relative to where the wheel was at startup). In order to determine variations in engine load due to suspension bind, scuff, and end-of-travel the absolute SWA is needed. Method 300 begins at 302, where the method may include receiving a relative SWA. For example, the relative SWA may be sensed by SWA sensor 172 of FIG. 1.

At 304, the method may include learning the absolute SWA based on the received relative SWA in view of vehicle operating parameters. For example, at 306, the method may include receiving a relative wheel speed signal. In one example, the relative wheel speed is provided by wheel speed sensor 174 of FIG. 1.

At 308, the method may include receiving a wheel yaw signal. In one example, the wheel YAW signal is provided by wheel position sensor 176 of FIG. 1. In some embodiments, the wheel speed signal and the wheel YAW signal may be provided from a brake module that controls braking at the wheels of the vehicle. At 310, the method may include determining the absolute SWA based on the relative SWA signal, the wheel speed signal, and the wheel YAW or rotation signal. In some embodiments, the wheel speed sensor and the wheel position sensor may send signals to the brake module where the absolute SWA may be learned. The absolute SWA may be learned anew at each vehicle startup after some period of straight line driving in which the relative wheel speed signal and wheel YAW signal may be accumulated. Note, at vehicle startup the absolute SWA signal is absent before it is learned by the brake module.

In order to adjust vehicle operation based on absolute SWA prior to the brake module learning absolute SWA, at 312, the method may include storing the learned absolute SWA. The learned absolute SWA may be stored for later use, during conditions when the absolute SWA cannot be immediately learned, for example at vehicle startup. In one example, the learned absolute SWA is stored in read-only memory of engine controller 106 of FIG. 1. Note that the absolute SWA may be learned and stored for later use in embodiments where the absolute SWA is not learned be the brake module.

At 314, the method may include determining if a vehicle is currently in a startup condition. In one example, the vehicle startup condition may be determined based on a key-on signal. If it is determined that the vehicle is in a startup condition the method moves to 316. Otherwise, the vehicle is not in a startup condition and the method returns to other operations.

At 316, the method may include inferring an absolute SWA based on the stored learned SWA in view of the relative SWA received from the SWA sensor. In one example, a lookup table may be employed to map the sensed relative SWA to the learned absolute SWA. The look up table may be stored in memory of the control system. The inferred absolute SWA may be utilized to control aspects of vehicle operation, such as to control engine idle speed as described above with reference to method 200. The inferred absolute SWA may be utilized at startup prior to the absolute SWA being learned via vehicle sensors (e.g., wheel speed sensor, wheel YAW position sensor).

At 318, the method may include confirming the inferred absolute SWA with the absolute SWA learned via the vehicle sensors. If the inferred absolute SWA does not match the learned absolute SWA, the inferred absolute SWA may be abandoned in favor of the learned absolute SWA. In some embodiments, the learned absolute SWA may be provided by the brake module after a period of straight lien driving.

By continuously learning the absolute SWA and inferring the absolute SWA at a next vehicle startup after learning the absolute SWA, engine control based on absolute SWA may be accurately performed without the delay associated with learning the absolute SWA strictly via vehicle sensor signals. In particular, the inferred absolute SWA may be particularly useful for accurate idle speed control that may be performed just after startup and prior to learning the absolute SWA. As discussed in further detail below the absolute SWA may be used to accurately compensate for variations in engine load at idle due to power steering operation.

In some embodiments, the above described method may be implemented by absolute SWA logic 178 of FIG. 1.

Figure 4:
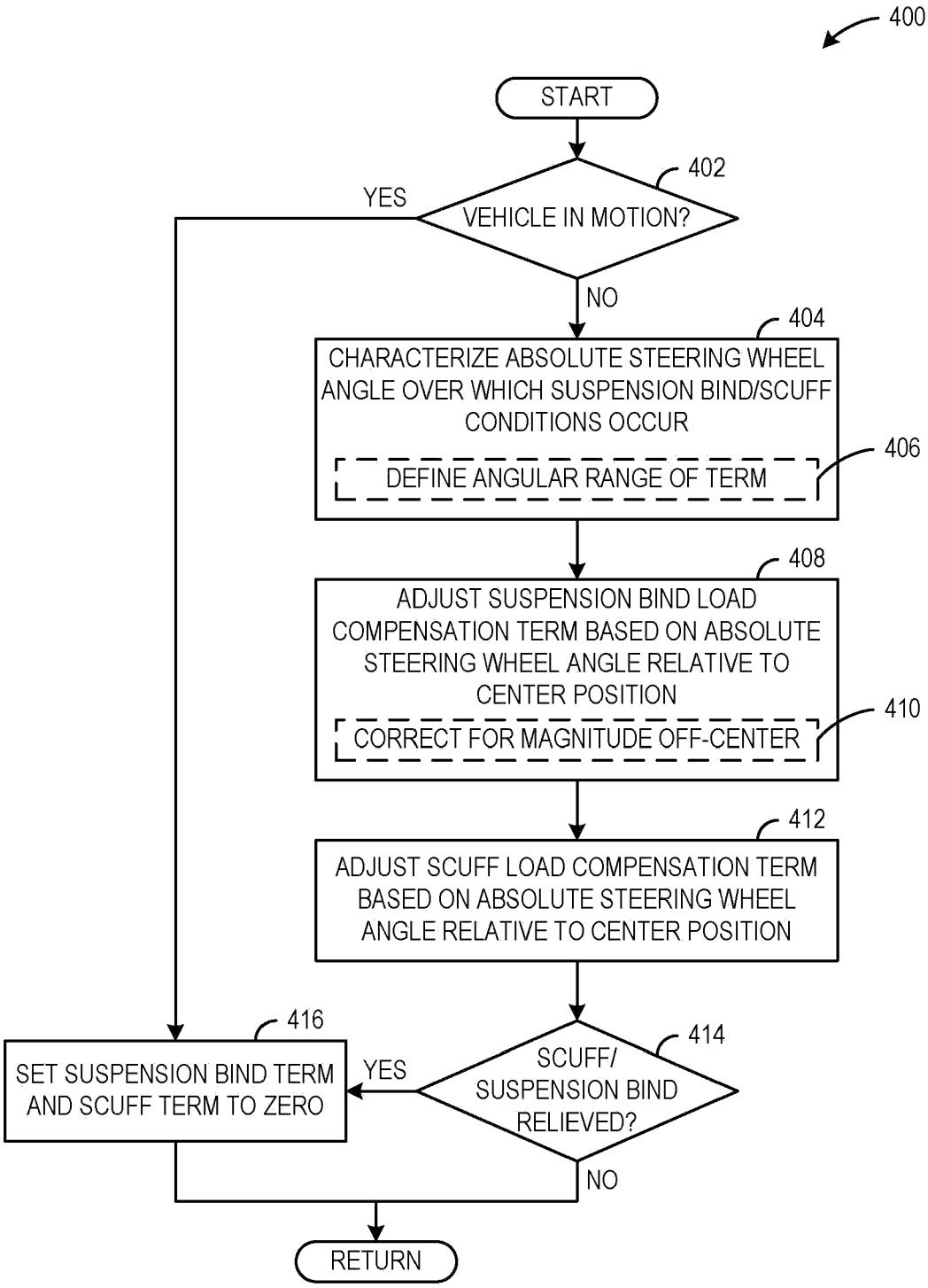
FIG. 4 is a flow diagram of an example method for determining an amount of engine load for which suspension bind and scuff is a contributing factor.

FIG. 4 is a flow diagram of an example method 400 for determining engine load compensation terms for suspension bind and scuff that may be used, in method 200 discussed above, to adjust engine operation at idle to compensate for variations in engine load due to power steering operation. The method may begin at 402, where the method may include determining if the vehicle is in motion. In one example, the determination is made based on a wheel speed signal from a wheel speed sensor. If the vehicle is not in motion or is stationary, the method moves to 404. Otherwise, the vehicle is in motion or is not stationary and the method moves to 416 where the method may include setting the suspension bind load compensation term and the scuff load compensation term to zero. The load compensation terms are set to zero because suspension bind and scuff conditions does not occur when the wheels are spinning, and thus do not affect engine load.

At 404, the method may include characterizing absolute steering wheel angle over which suspension bind and scuff conditions occur. The characterization may be defined relative to a center steering wheel position that would not be known using only the relative SWA provided by a SWA sensor since relative SWA is not defined relative to a center or end-of-travel position of the steering wheel. In some embodiments, at 406, the amount of engine load to which the suspension bind and/or scuff contribute may be characterized into different regions or angular ranges of absolute steering wheel angle. For example, an angular range of steering wheel angle may be characterized as a region where suspension bind/scuff occurs. Within the region, the characterization may define an amount of engine load increase due to the suspension bind/scuff.

At 408, the method may include adjusting the suspension bind load compensation term based on the absolute steering wheel angle according to the characterization. In some characterizations, the amount of engine load within a suspension bind region may be varied. For example, at 410 the suspension bind load compensation term may be corrected for the magnitude of the absolute steering wheel angle away from the center position within the characterized angular range. In other words, the load compensation may be prorated based on the amount of suspension bind. In one particular example, the amount of engine load increases as the steering wheel angle moves away from the center position through the suspension bind region or angular range. Further, the engine load decreases as the steering wheel angle moves toward the center position through the suspension bind region.

At 412, the method may include adjusting the scuff load compensation term based on the absolute steering wheel angle according to the characterization. The scuff region defined by the characterization may sit beyond the suspension bind region away from the center position of the steering wheel. The scuff load compensation term may be stable and set at a high or maximum value of the suspension bind load compensation term. While the absolute steering wheel angle is within the scuff region or angular range, the increased engine load and corresponding increase in engine speed may be maintained at that value.

At 414, the method may include determining if scuff/suspension bind is relieved based on the absolute steering wheel angle. The scuff/suspension bind may be relieved when the absolute steering wheel angle exits the characterized suspension bind and scuff regions or angular range toward a steering wheel center position. If it is determined that scuff/suspension bind is relieved the method moves to 416. Otherwise, scuff/suspension bind is not relieved and the suspension bind and scuff load compensation term are adjusted according to the characterization. If the steering wheel is released during scuff, and returns to the relevant suspension bind position, the scuff load compensation term may be set to zero and the suspension bind compensation term may be adjusted according to the characterization.

At 416, the method may include setting the suspension bind load compensation term and the scuff load compensation term to zero since neither of the suspension bind and scuff conditions currently occur and do not cause increases in engine load. In other words, engine output may be adjusted to decrease the engine idle speed to account for no engine load contribution from suspension bind/scuff.

As discussed above, the suspension bind engine load compensation term and the scuff engine load compensation term may be used, in method 200 described above, to compensate for variations in engine load due suspension bind and scuff conditions that occur during power steering operation. As such, each compensation term may be representative of an amount of engine output that may be added to a total engine output or engine idle speed to meet a specified engine load. By compensating for the variation in engine load, the engine idle speed may be set to a lower engine speed and selectively increased to handle the variations in engine load based on the power steering operation conditions. In this way, idle speed may be lowered resulting in improved vehicle fuel economy performance.

Note that the above described method may be implemented using logic that ensures suspension bind compensation torque varies up and down as absolute steering wheel angle changes within the characterized angular range of suspension bind. Further, the logic may be configured to hold the compensation value when the steering wheel is held against suspension bind, and may be further set to zero when suspension bind is relieved or exits the characterized angular range.

Figure 5:
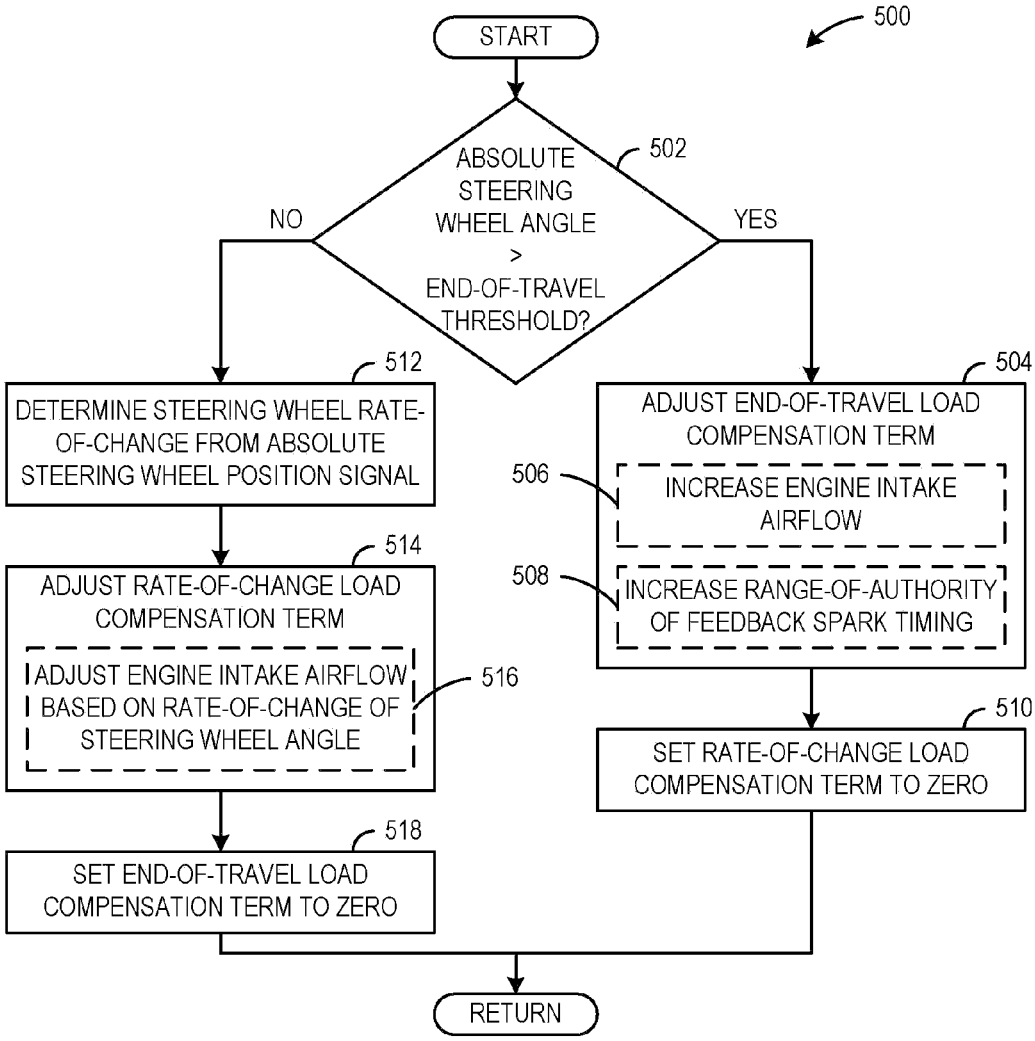
FIG. 5 is a flow diagram of an example method for determining an amount of engine load for which steering wheel rate-of-change and end-of travel are contributing factors.

FIG. 5 is a flow diagram of an example method 500 for determining engine load compensation terms for steering wheel end-of-travel and rate-of-change that may be used, in method 200 discussed above, to adjust engine operation at idle to compensate for variations in engine load due to power steering operation. The method may begin at 502, where the method may include determining if the steering wheel angle is greater than an end-of-travel threshold. The end-of-travel threshold may include steering wheel positions that are substantially the farthest position away from the center position of the steering wheel. In other words, the end-of-travel threshold includes steering wheel positions where the road wheels are turned completely to the left or right. In a rack-and-pinion power steering system, the end-of-travel-position occurs when the pinion gear has traveled to substantially an end of the rack. If it is determined that absolute steering wheel angle is greater than the steering wheel end-of-travel threshold the method moves to 504. Otherwise, the steering wheel angle is not greater than the end-of-travel threshold and the method moves to 512.

Note the steering wheel threshold may include left and right (or positive and negative) thresholds to define each end-of-travel position of the steering wheel.

As discussed above, due to the design of the steering gear, when the steering wheel reaches an end-of-travel position the hydraulic pressure dead-heads resulting in a spike in hydraulic pressure and consequently engine load. Accordingly, at 504, the method may include adjusting the end-of-travel load compensation term to compensate for the spike in engine load since the absolute steering wheel angle is greater than the end-of-travel threshold. In particular, the end-of-travel load compensation term may be increased by a predetermined amount to compensate for the increase in engine load.

In some embodiments, adjusting the end-of-travel load compensation term may include increasing engine intake airflow to increase engine idle speed at 508. Furthermore, in some embodiments, the range-of-authority of a feedback spark system of the engine may be increased to increase engine idle speed at 510. In particular, by increasing the range of authority spark timing may be advanced or retarded in a greater operating range to generate additional torque output. Since feedback spark is significantly faster acting than air, this effectively deals with any delay in airflow delivery near the steering wheel end-of-travel condition that would slow engine load compensation reaction timing. Note that airflow and range of authority of feedback spark may be increased cooperatively to increase engine idle speed. Further note that the increased idle speed may be maintained while the absolute steering wheel angle is greater than the end-of-travel threshold.

At 510, the method may include setting the rate-of-change load compensation term to zero since the steering wheel has reached an end-of-travel position and is not moving so there is no change in absolute steering wheel angle to generate an increase in engine load.

Returning to 502, if the absolute steering wheel angle is not greater than the end-of-travel threshold the method moves to 512. At 512, the method may include determining a steering wheel position rate-of-change from the absolute steering wheel position signal. At 514, the method may include adjusting the rate-of-change load compensation term based on the rate-of-change of the absolute steering wheel angle. As described above, the rate-of-change condition may be related to engine load variations based on the power steering conditions described above. In particular, delays in filling of the intake manifold of the engine may occur at idle due to variations in engine load that occur during the above described conditions. These filing delays result in intake air requests being delayed (e.g., by approximately ½ second). The intake air request delays result in reactive air compensation being delivered too late to correct idle speed fluctuations.

Accordingly, in some embodiments, adjusting the rate-of-change load compensation term may include adjusting engine intake airflow based on the rate-of-change of the steering wheel angle at 516. In particular, the rate-of-change information may be used to create a "leading" term which effectively compensates for manifold filling delays when operating the steering wheel in areas where the end-of-travel logic is not active. In one example, the leading term is increased as rate-of-change increases toward an end-of-travel position of the steering wheel to compensate for manifold filing delays that occur at the end-of-travel condition.

At 518, the method may include setting the end-of-travel load compensation term to zero since the steering wheel is not in an end-of-travel position and thus there is no end-of-travel engine load contribution.

By compensating for the variation in engine load due to end-of-travel and rate-of-change conditions, the engine idle speed may be set to a lower engine speed and selectively increased to handle the variations in engine load based on the power steering operation conditions. In this way, idle speed may be lowered resulting in improved vehicle fuel economy performance.

Note that the above described method may be implemented using logic that varies end-of-travel and rate of change compensation torque up and down as absolute steering wheel angle changes. Further, the logic may be configured to hold the end-of-travel compensation value when the steering wheel is held in the end-of-travel position, and may be further set to zero when the end-of-travel condition is relieved.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A vehicle having at least one road wheel, the vehicle comprising:

a steering wheel;

a hydraulic power steering system to assist movement of the at least one road wheel responsive to rotation of the steering wheel;

a steering wheel angle sensor to generate a relative steering wheel angle signal that is relative to a steering wheel position at vehicle startup;

an internal combustion engine; and a control system configured to, at vehicle startup, receive the relative steering wheel angle signal, learn an absolute steering wheel angle based on the relative steering wheel angle signal and a stored absolute steering wheel angle learned during previous vehicle operation, and during an idle condition when the vehicle is stationary, control the internal combustion engine at a first engine speed, and in response to the learned absolute steering wheel angle entering a suspension bind angular range defined relative to a steering wheel center position, control the internal combustion engine at a second speed higher than the first speed.

2. The vehicle of claim 1, wherein the second speed varies as a magnitude of the learned absolute steering wheel angle relative to the steering wheel center position varies within the suspension bind angular range.

3. The vehicle of claim 2, wherein the second speed increases as the magnitude of the learned absolute steering wheel angle relative to the steering wheel center position increases within the suspension bind angular range.

4. The vehicle of claim 2, wherein the control system is configured to control the internal combustion engine to maintain the second speed when the learned absolute steering wheel angle enters a scuff angular range positioned beyond the suspension bind angular range relative to the steering wheel center position.

5. The vehicle of claim 1, wherein the control system is configured to control the internal combustion engine to reduce speed from the second speed to the first speed in response to the learned absolute steering wheel angle exiting the suspension bind angular range toward the steering wheel center position.

6. The vehicle of claim 1, wherein the control system is configured to control the internal combustion engine at a third speed different from the first speed in response to the learned absolute steering wheel angle being greater than an end-of-travel steering wheel position.

7. A vehicle having at least one road wheel, the vehicle comprising:

a steering wheel;

a hydraulic power steering system to assist movement of the at least one road wheel responsive to rotation of the steering wheel;

a steering wheel angle sensor to generate a relative steering wheel angle signal that is relative to a steering wheel position at vehicle startup;

a wheel speed sensor to generate a wheel speed signal;

a wheel position sensor to generate a wheel position signal;

an internal combustion engine; and a control system configured to receive the relative steering wheel angle signal, the wheel speed signal, and the wheel position signal; store a stored absolute steering wheel angle based on the relative steering wheel angle signal, the wheel speed signal, and the wheel position signal; at next vehicle startup, infer a learned absolute steering wheel angle based on the relative steering wheel angle signal and the stored absolute steering wheel angle; and during an idle condition when the vehicle is stationary, control the internal combustion engine at a first engine speed, and in response to the learned absolute steering wheel angle entering a suspension bind angular range defined relative to a steering wheel center position, control the internal combustion engine at a second speed higher than the first speed.

8. The vehicle of claim 7, wherein the second speed varies as the learned absolute steering wheel angle varies within the suspension bind angular range.

9. The vehicle of claim 7, wherein the control system is configured to control the internal combustion engine to maintain the second speed when the learned absolute steering wheel angle enters a scuff angular range positioned beyond the suspension bind angular range relative to the steering wheel center position.

10. The vehicle of claim 7, wherein the control system is configured to control the internal combustion engine at a third speed different from the first speed in response to the learned absolute steering wheel angle being greater than an end-of-travel steering wheel position.

* * * * *